US011006720B2

(12) United States Patent
Hsu

(10) Patent No.: US 11,006,720 B2
(45) Date of Patent: May 18, 2021

(54) CONCENTRATOR NOZZLE FOR HAIR DRYER

(71) Applicant: Shih-Ling Hsu, Tainan (TW)

(72) Inventor: Shih-Ling Hsu, Tainan (TW)

( * ) Notice: Subject to any disclaimer, the term of this patent is extended or adjusted under 35 U.S.C. 154(b) by 119 days.

(21) Appl. No.: 16/375,540

(22) Filed: Apr. 4, 2019

(65) Prior Publication Data

US 2020/0315311 A1 Oct. 8, 2020

(51) Int. Cl.
*A45D 20/12* (2006.01)

(52) U.S. Cl.
CPC ..... *A45D 20/12* (2013.01)

(58) Field of Classification Search
CPC ..... A45D 20/00; A45D 20/12; A45D 20/122; A45D 20/124
See application file for complete search history.

(56) References Cited

U.S. PATENT DOCUMENTS 4,039,774 A * 8/1977 Kata ..... A45D 20/10 392/384
4,132,360 A * 1/1979 Lee, Jr. ..... A45D 20/124 239/383
4,177,824 A * 12/1979 Gnaga ..... A45D 2/36 132/238
4,214,597 A * 7/1980 Glassman ..... A45D 2/36 132/223
4,295,283 A * 10/1981 Tomaro ..... A45D 20/124 239/383
4,590,687 A * 5/1986 Caruso ..... A45D 20/122 132/112
4,629,863 A * 12/1986 Giordano ..... A45D 20/122 132/212
5,161,317 A * 11/1992 McDougall ..... A45D 20/124 239/383
5,471,763 A * 12/1995 McArthur ..... A45D 20/124 34/96
5,488,783 A * 2/1996 Parkinson ..... A45D 20/122 34/283
5,671,547 A * 9/1997 Truchet ..... A45D 20/124 34/96
5,715,847 A * 2/1998 Rolf ..... A45D 20/122 132/129
5,845,656 A * 12/1998 Assmann ..... A45D 20/122 132/271
8,091,564 B2 * 1/2012 Hafemann ..... A45D 20/12 132/271
2009/0188125 A1 * 7/2009 Fung ..... A45D 20/12 34/68

(Continued)

*Primary Examiner* — Nicholas D Lucchesi

(57) ABSTRACT

A concentrator nozzle for a hair dryer contains: a wind collector and a rotatable operation member. The wind collector includes a connection groove formed on a circular bottom thereof. An upper end of the rotatable operation member includes a cutout extending to a lower end of the rotatable operation member. The connection groove is connected with a coupling segment on a body of the hair dryer so as to receive airflow produced by the hair dryer, and the wind collector drives the rotatable operation member to rotate so as to produce a vortex flow for curling the user's hairs fixed on the concentrator nozzle. Then, the hair dryer blows hot air to the user's hairs, thus forming the user's hairs in a desired curling shape.

3 Claims, 7 Drawing Sheets

(56) References Cited

U.S. PATENT DOCUMENTS

| | | | | |
|---|---|---|---|---|
| 2010/0263684 | A1* | 10/2010 | De Benedictis | A45D 6/02 132/272 |
| 2011/0209721 | A1* | 9/2011 | Yahnker | A45D 20/12 132/271 |
| 2011/0296705 | A1* | 12/2011 | Yoe | A45D 20/12 34/101 |
| 2012/0260516 | A1* | 10/2012 | Han | A45D 20/124 34/97 |
| 2013/0104415 | A1* | 5/2013 | Han | A45D 20/124 34/283 |
| 2013/0174439 | A1* | 7/2013 | Ragosta | A45D 20/124 34/283 |
| 2017/0079401 | A1* | 3/2017 | Courtney | A45D 20/124 |

* cited by examiner

CONCENTRATOR NOZZLE FOR HAIR DRYER

FIELD OF THE INVENTION

The present invention relates to a concentrator nozzle for a hair dryer which receives airflow producing from the hair dryer, and the wind collector drives the rotatable operation member to rotate so as to produce vortex flow for curling the user's hairs 5 fixed on the concentrator nozzle, then the hair dryer blows hot air to the user's hairs, thus forming the user's hairs in the desired curling shape.

BACKGROUND OF THE INVENTION

A conventional hair dryer contains a fan unit and a heating unit, the fan unit draws air from an external environment to produce airflow, and the airflow is heated by the heating unit to form hot air which is discharged out of an air outlet of the hair dryer. The air outlet is circular so as to discharge the hot air. To discharge the hot air forcefully, a concentrator nozzle is connected with the air outlet, but such a concentrator nozzle cannot curl user's hairs.

The present invention has arisen to mitigate and/or obviate the afore-described disadvantages.

SUMMARY OF THE INVENTION

The primary aspect of the present invention is to provide a concentrator nozzle for a hair dryer which receives airflow producing from the hair dryer, and the wind collector drives the rotatable operation member to rotate so as to produce vortex flow for curling the user's hairs 5 fixed on the concentrator nozzle, then the hair dryer blows hot air to the user's hairs, thus forming the user's hairs in the desired curling shape.

DETAILED DESCRIPTION OF THE PREFERRED EMBODIMENTS

Figure 1:
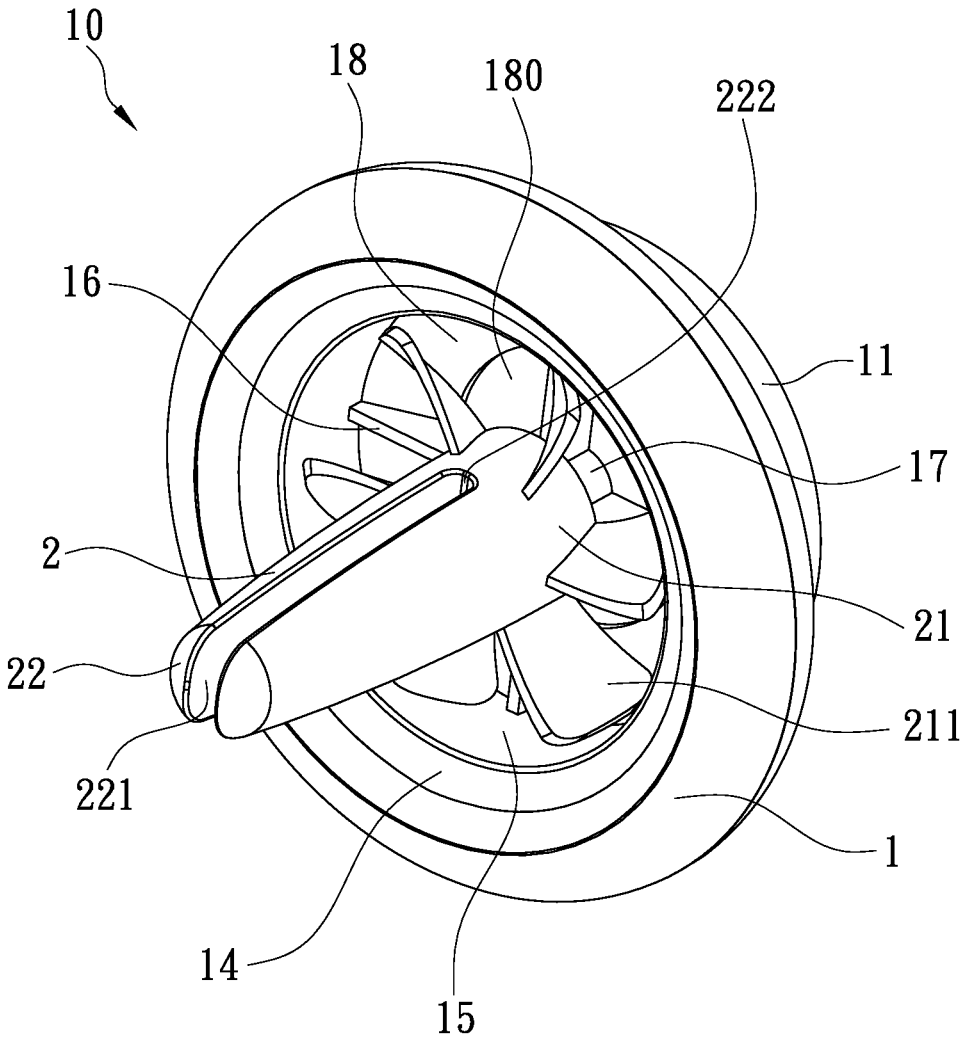
FIG. 1 is a perspective view showing the assembly of a concentrator nozzle for a hair dryer according to a preferred embodiment of the present invention.

With reference to FIGS. 1-7, a concentrator nozzle 10 for a hair dryer 4 according to a preferred embodiment of the present invention is applied to curl and form user's hairs 5 in a desired curling shape, and the concentrator nozzle 10 comprises: a wind collector 1 and a rotatable operation member 2.

The wind collector 1 includes a connection grove 12 formed on a bottom 11 thereof and connected with a coupling segment 42 on a front end of a body 41 of the hair dryer 4 so as to receive airflow producing from the hair dryer 4, and the wind collector 1 drives the rotatable operation member 2 to rotate so as to produce vortex flow for curling the user's hairs 5 fixed on the concentrator nozzle 10, then the hair dryer 4 blows hot air to the user's hairs 5, thus forming the user's hairs 5 in the desired curling shape.

Figure 2:
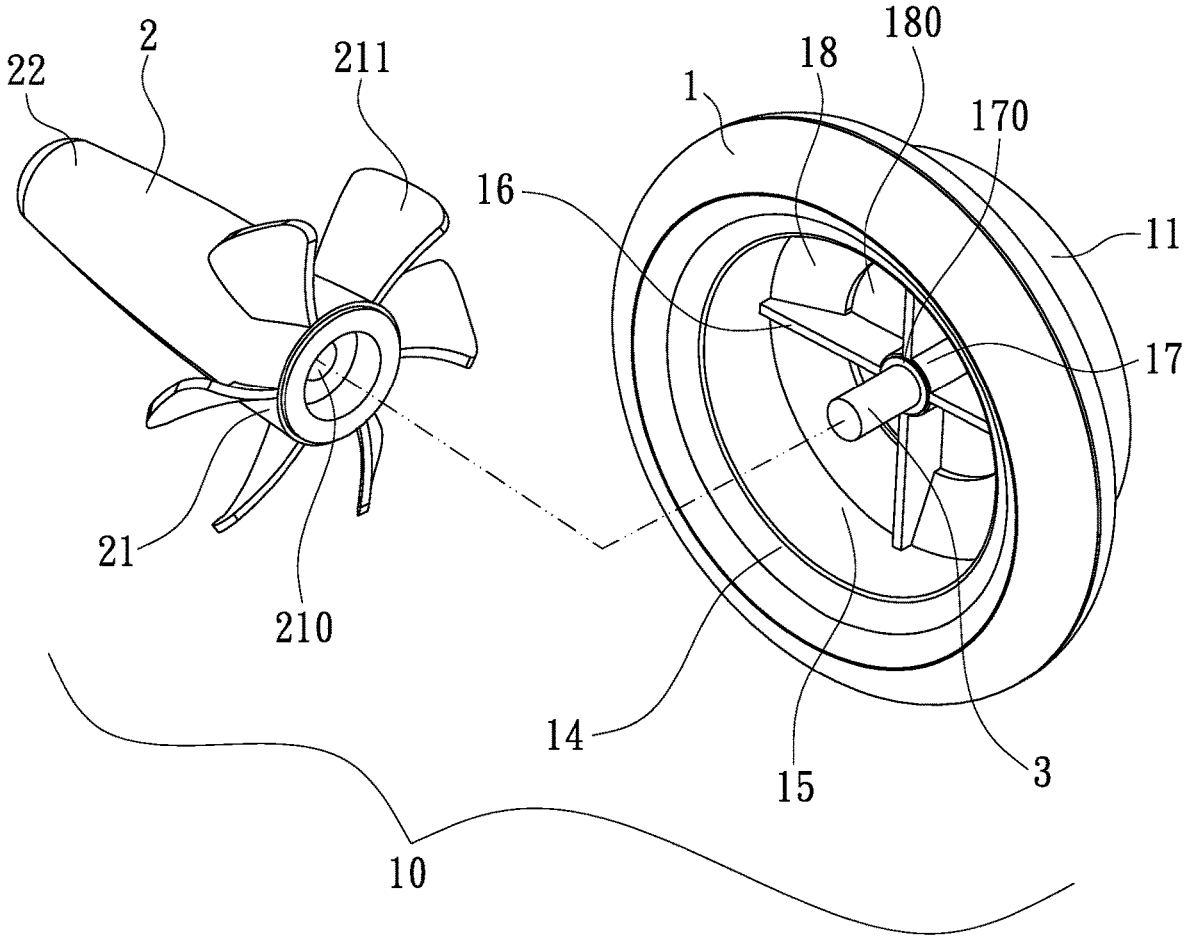
FIG. 2 is a perspective view showing the exploded components of the concentrator nozzle for the hair dryer according to the preferred embodiment of the present invention.
Figure 3:
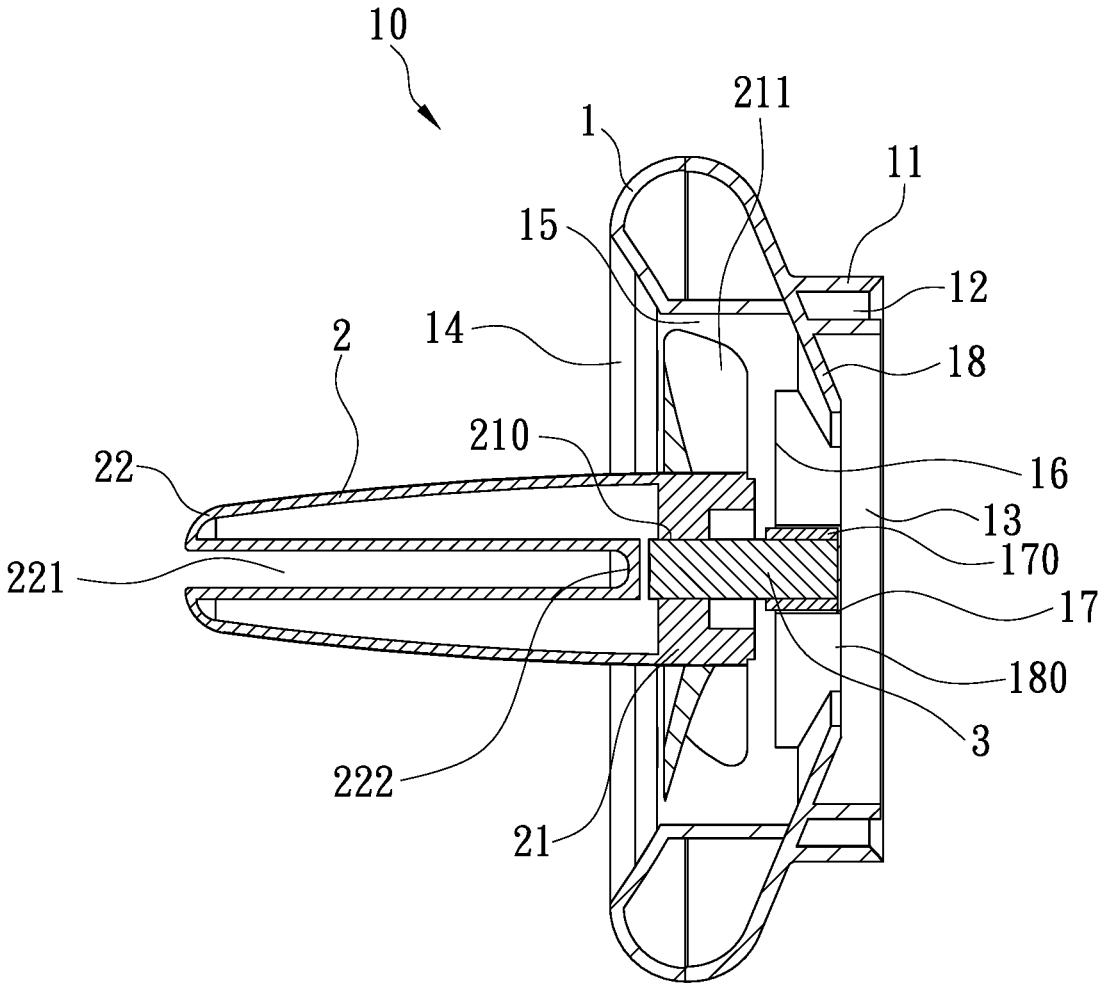
FIG. 3 is a cross sectional view showing the assembly of the concentrator nozzle for the hair dryer according to the preferred embodiment of the present invention.

Referring to FIGS. 2 and 3, the wind collector 1 includes the circular bottom 11, a diameter of which is circular, the connection grove 12 formed on the circular bottom 11 of the wind collector 1, an air inlet 13 defined on a center of the circular bottom 11 of the wind collector 1, an air outlet 14 formed on a top of the wind collector 1, a cavity 15 defined between the air inlet 13 and the air outlet 14, and multiple spaced supports 16 arranged in the cavity 15 of the wind collector 1 and extending radially from a hollowly central shaft 17 of the wind collector 1, wherein the hollow central shaft 17 has a bearing 170 accommodated therein. The wind collector 1 further includes multiple shoulders 18 respectively extending among the multiple spaced supports 16 and an inner wall of the wind collector 1, and multiple guide orifices 180 respectively formed among the multiple shoulders 18 and the multiple spaced supports 16, wherein the air inlet 13, the multiple guide orifices 180, and the air outlet 14 are communicated with one another.

As shown in FIGS. 1-2, a cross section of the rotatable operation member 2 is formed in a cone shape, and the rotatable operation member 2 includes a lower end 21 and an upper end 22, wherein a diameter of the cross section of the rotatable operation member 2 progressively decreases from the lower end 21 of the rotatable operation member 2 to the upper end 22 of the rotatable operation member 2. The upper end 22 of the rotatable operation member 2 includes a cutout 221 extending from the upper end 22 to the lower end 21, the lower end 21 has a fixing orifice 210 for accommodating a first end of a column 3, and a second end of the column 3 is rotatably connected with the bearing 170 of the hollow central shaft 17 of the wind collector 1 so that the rotatable operation member 2 is rotatably connected with and rotates relative to the wind collector 1. The lower end 21 of the rotatable operation member 2 has multiple curved blades 211 separately arranged therearound so as to swirl the airflow from the hair dryer 4 and to rotate the rotatable operation member 2, thus producing the vortex flow.

Figure 4:
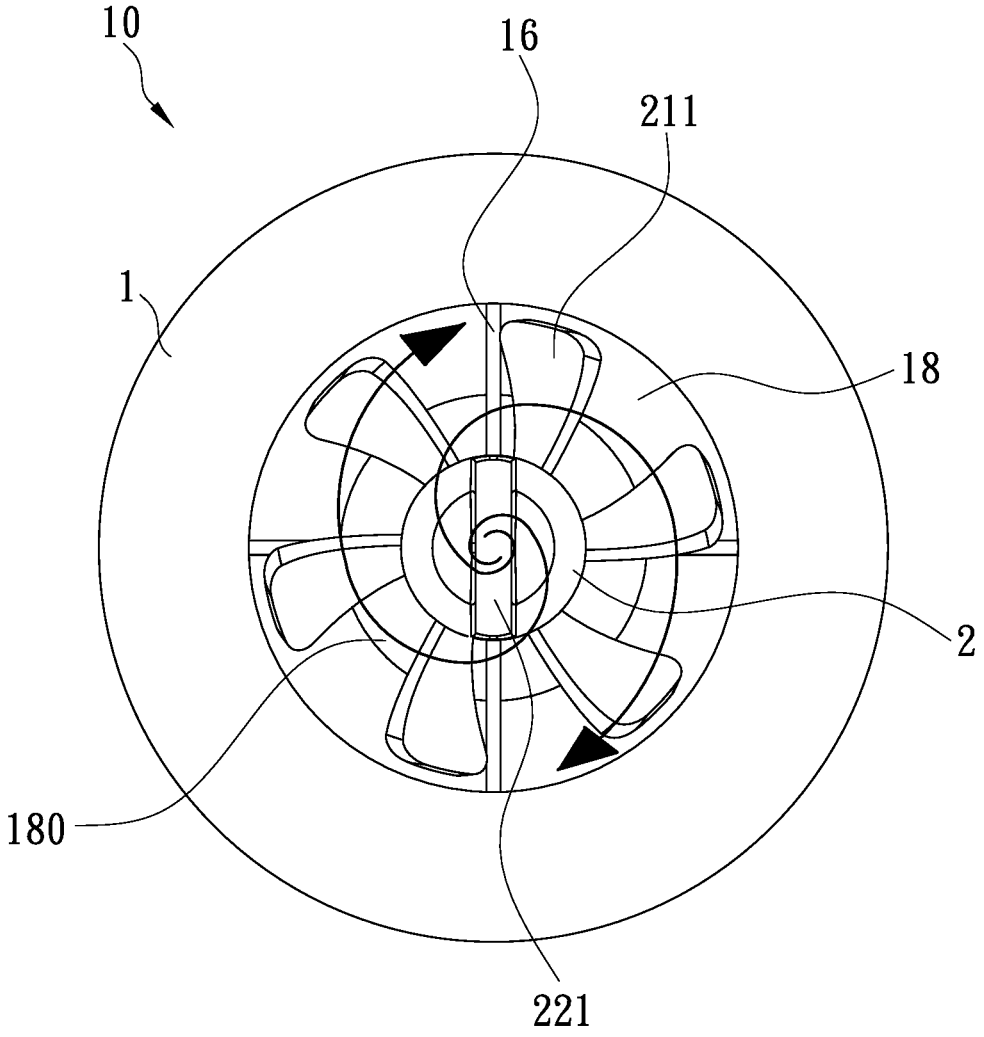
FIG. 4 is a front elevational view showing the assembly of the concentrator nozzle for the hair dryer according to the preferred embodiment of the present invention.
Figure 5:
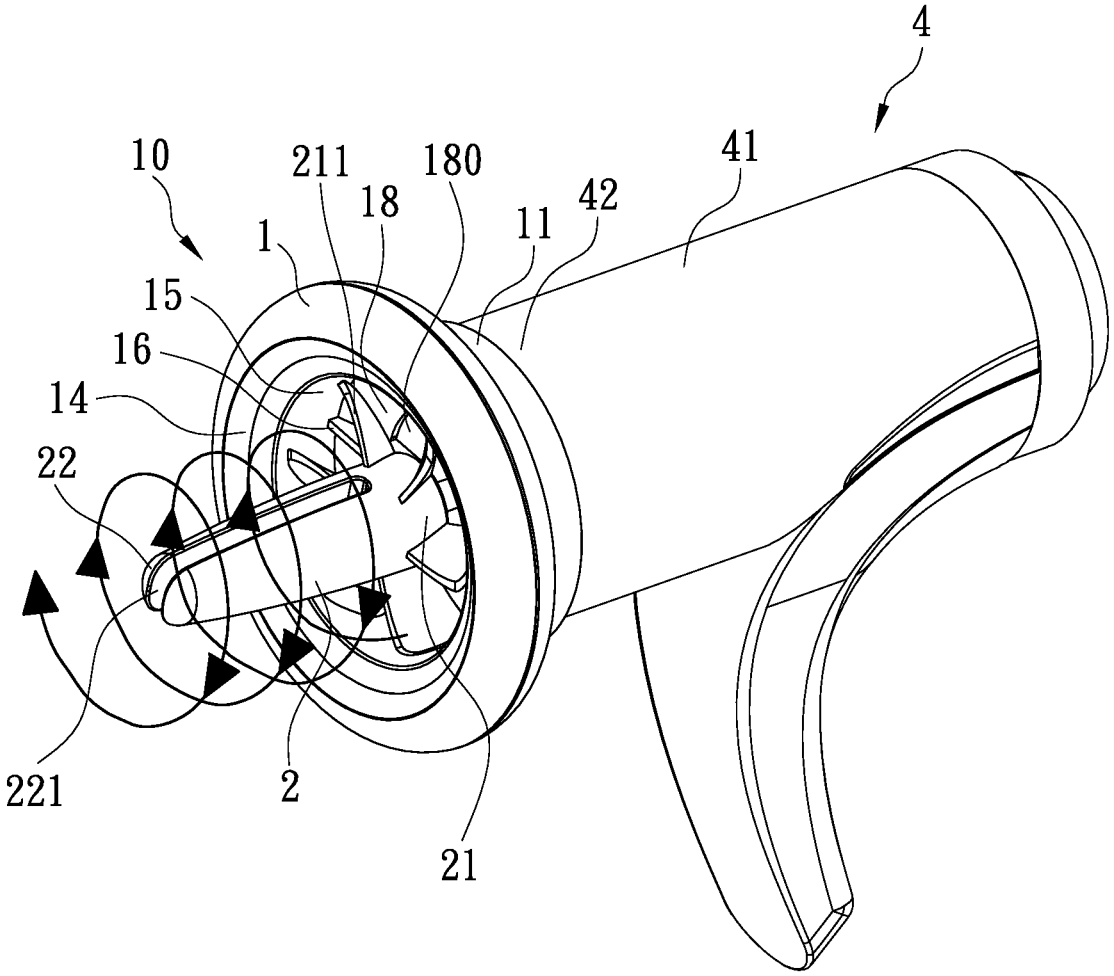
FIG. 5 is a perspective view showing the operation of the concentrator nozzle for the hair dryer according to the preferred embodiment of the present invention.
Figure 6:
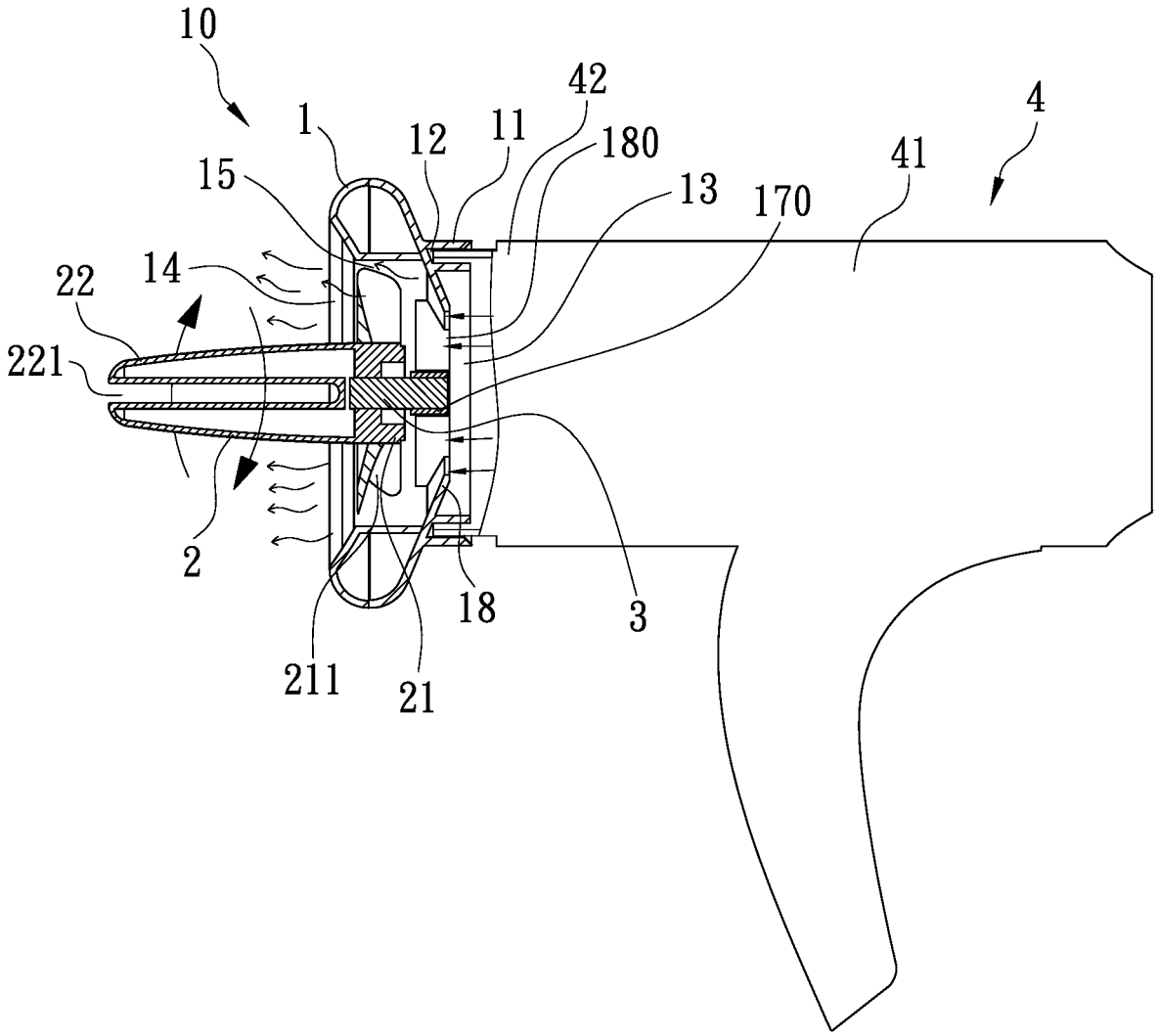
FIG. 6 is a cross sectional view showing the operation of a part of the concentrator nozzle for the hair dryer according to the preferred embodiment of the present invention.

After connecting the wind collector 1 and the rotatable operation member 2, as illustrated in FIGS. 1 and 3, the multiple curved blades 211 of the rotatable operation member 2 is located inside the cavity 15 of the wind collector 1, and a bottom 222 of the cutout 221 of the rotatable operation member 2 is located inside the air outlet 14 of the wind collector 1. Referring further to FIGS. 4-6, when the concentrator nozzle 10 is mounted on the front end of the body 41 of the hair dryer 4 and operates, the airflow flows into the cavity 15 from the air inlet 13 of the wind collector 1 via the multiple guide orifices 180 so as to drive the rotatable operation member 2 to rotate. Accordingly, the guide orifices 180 gather the airflow from the hair dryer 4, and the multiple curved blades 211 swirl the airflow to produce the vortex flow flowing out of the air outlet 14, as shown in FIGS. 4 and 5.

Figure 7:
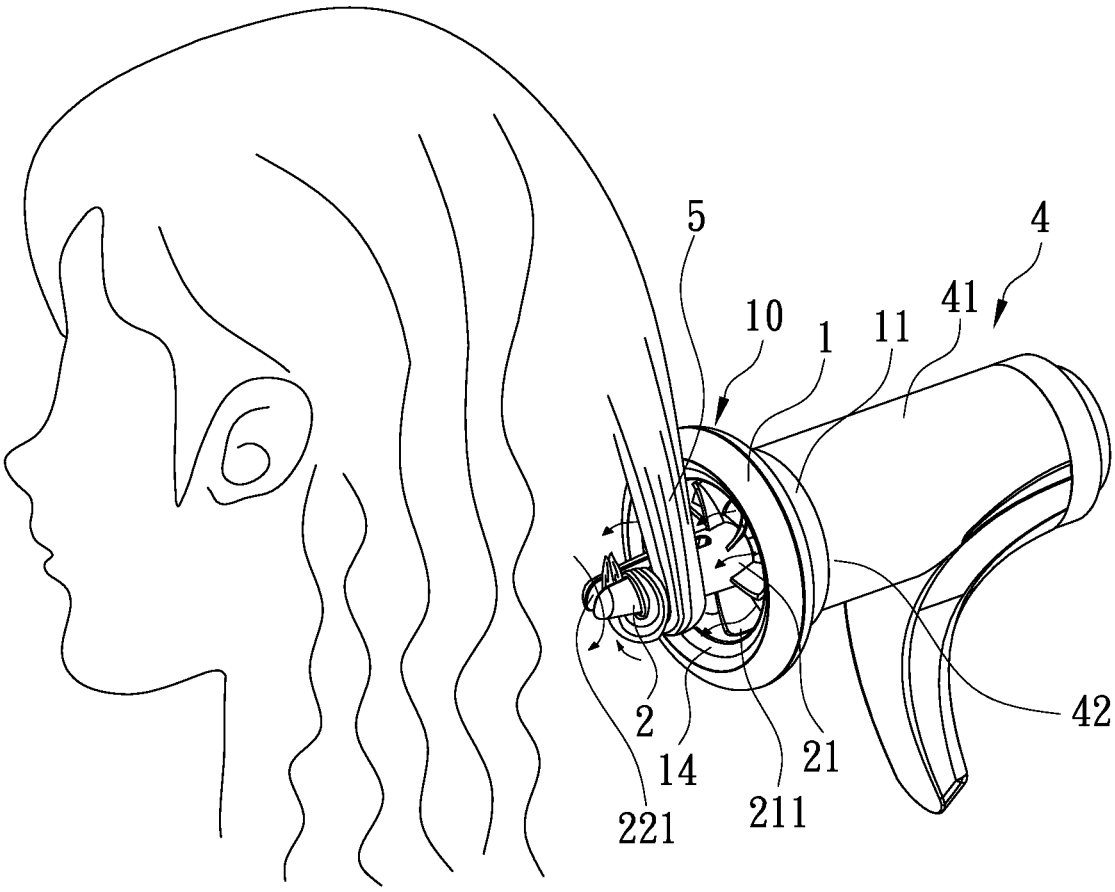
FIG. 7 is a perspective view showing the application of the concentrator nozzle for the hair dryer according to the preferred embodiment of the present invention.

With reference to FIG. 7, the user's hairs 5 are put into the cutout 221 of the rotatable operation member 2 of the concentrator nozzle 10, and the hair dryer 4 is turned on so that the airflow drives the rotatable operation member 2 to rotate. Thereafter, the airflow is swirled by the multiple curved blades 211 to produce the vortex flow flowing out of the air outlet 14, thus forming the user's hairs 5 in the desired curling shape easily and quickly.

Thereby, the wind collector 1 receives the airflow producing from the hair dryer 4 and drives the rotatable operation member 2 to rotate so as to produce the vortex flow for curling the user's hairs 5 fixed on the concentrator nozzle 10, and the hair dryer 4 blows the hot air to the user's hairs 5, thus forming the user's hairs in the desired curling shape.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention

What is claimed is:

1. A concentrator nozzle for a hair dryer comprising:

a wind collector and a rotatable operation member;

the wind collector including a connection groove formed on a circular bottom of the wind collector, an upper end of the rotatable operation member including a cutout extending from the upper end to a lower end of the rotatable operation member, wherein the connection groove of the wind collector is adapted to be connected with a coupling segment on a front end of a body of the hair dryer so as to receive airflow produced from the hair dryer, and the wind collector drives the rotatable operation member to rotate so as to produce a vortex adapted to cause hair of a user to curl on the concentrator nozzle, the hair dryer blowing heated air to the hair of the user to form the hair of the user in a desired curling shape;

wherein the wind collector includes an air inlet defined on a center of the circular bottom of the wind collector, an air outlet formed on a top of the wind collector, a cavity defined between the air inlet and the air outlet, and multiple spaced supports arranged in the cavity of the wind collector and extending radially from a hollow central shaft of the wind collector, wherein the hollow central shaft has a bearing accommodated therein, the wind collector further includes multiple shoulders respectively extending among the multiple spaced supports and an inner wall of the wind collector, and multiple guide orifices respectively formed among the multiple shoulders and the multiple spaced supports, wherein the air inlet, the multiple guide orifices, and the air outlet are in communications with one another.

2. A concentrator nozzle for a hair dryer comprising:

a wind collector and a rotatable operation member;

the wind collector including a connection groove formed on a circular bottom of the wind collector, an upper end of the rotatable operation member including a cutout extending from the upper end to a lower end of the rotatable operation member, wherein the connection groove of the wind collector is adapted to be connected with a coupling segment on a front end of a body of the hair dryer so as to receive airflow produced from the hair dryer, and the wind collector drives the rotatable operation member to rotate so as to produce a vortex adapted to cause hair of a user to curl on the concentrator nozzle, the hair dryer blowing heated air to the hair of the user to form the hair of the user in a desired curling shape;

wherein a cross section of the rotatable operation member is conical, a diameter of the cross section of the rotatable operation member progressively decreasing from the lower end of the rotatable operation member to the upper end of the rotatable operation member; the lower end has a fixing orifice for accommodating a first end of a column, and a second end of the column is rotatably connected with a bearing of the hollow central shaft of the wind collector so that the rotatable operation member is rotatably connected with and rotates relative to the wind collector; and the lower end of the rotatable operation member has multiple curved blades separately arranged therearound so as to swirl the airflow from the hair dryer and to rotate the rotatable operation member, thus producing the vortex flow.

3. A concentrator nozzle for a hair dryer comprising:

A concentrator nozzle for a hair dryer comprising:

a wind collector and a rotatable operation member;

the wind collector including a connection groove formed on a circular bottom of the wind collector, an upper end of the rotatable operation member including a cutout extending from the upper end to a lower end of the rotatable operation member, wherein the connection groove of the wind collector is adapted to be connected with a coupling segment on a front end of a body of the hair dryer so as to receive airflow produced from the hair dryer, and the wind collector drives the rotatable operation member to rotate so as to produce a vortex adapted to cause hair of a user to curl on the concentrator nozzle, the hair dryer blowing heated air to the hair of the user to form the hair of the user in a desired curling shape;

wherein after connecting the wind collector and the rotatable operation member, multiple curved blades of the rotatable operation member are located inside a cavity of the wind collector, and a bottom of the cutout of the rotatable operation member is located inside an air outlet of the wind collector, when the concentrator nozzle is mounted on the front end of the body of the hair dryer and operates, airflow flows into the cavity from an air inlet of the wind collector via multiple guide orifices so as to drive the rotatable operation member to rotate, the multiple guide orifices gathering the airflow from the hair dryer, and the multiple curved blades swirl the airflow to produce the vortex flow flowing out of the air outlet.

* * * * *